US006629068B1

(12) United States Patent
Horos et al.

(10) Patent No.: US 6,629,068 B1
(45) Date of Patent: Sep. 30, 2003

(54) CALCULATING A POSTFILTER FREQUENCY RESPONSE FOR FILTERING DIGITALLY PROCESSED SPEECH

(75) Inventors: Jacek Horos, Hampshire (GB); Alistair Black, Surrey (GB)

(73) Assignee: Nokia Mobile Phones, Ltd., Espoo (FI)

( * ) Notice: Subject to any disclaimer, the term of this patent is extended or adjusted under 35 U.S.C. 154(b) by 0 days.

(21) Appl. No.: 09/416,228

(22) Filed: Oct. 12, 1999

(30) Foreign Application Priority Data

Oct. 13, 1998 (GB) ..... 9822347

(51) Int. Cl.[7] ..... G10L 11/00
(52) U.S. Cl. ..... 704/228; 704/205
(58) Field of Search ..... 704/219, 220, 704/224, 225, 226, 227, 228, 205

(56) References Cited

U.S. PATENT DOCUMENTS 4,827,516 A * 5/1989 Tsukahara et al. ..... 704/203
4,914,701 A * 4/1990 Zibman ..... 704/203
4,969,192 A 11/1990 Chen et al. ..... 381/31
5,550,924 A * 8/1996 Helf et al. ..... 381/94.3
5,673,361 A * 9/1997 Ireton ..... 704/216
5,706,395 A * 1/1998 Arslan et al. ..... 704/226
5,727,123 A * 3/1998 McDonough et al. ..... 704/224
5,890,108 A * 3/1999 Yeldener ..... 704/208
5,953,696 A * 9/1999 Nishiguchi et al. ..... 704/209
6,098,036 A * 8/2000 Zinser et al. ..... 704/206
6,138,093 A * 10/2000 Ekudden et al. ..... 704/205

FOREIGN PATENT DOCUMENTS

EP 0294020 A2 12/1988

* cited by examiner

*Primary Examiner*—Tālivaldis Ivars Šmits
*Assistant Examiner*—Abul K. Azad
(74) *Attorney, Agent, or Firm*—Perman & Green, LLP

(57) ABSTRACT

A method for calculating a postfilter frequency response for filtering digitally processed speech, the method comprising identifying at least one format of a speech spectrum of the digitally processed speech; and normalizing points of the speech spectrum with respect to an identified format.

7 Claims, 3 Drawing Sheets

BLOCK DIAGRAM OF FREQUENCY DOMAIN SHORT TERM POSTFILTER

BLOCK DIAGRAM OF FREQUENCY DOMAIN SHORT TERM POSTFILTER

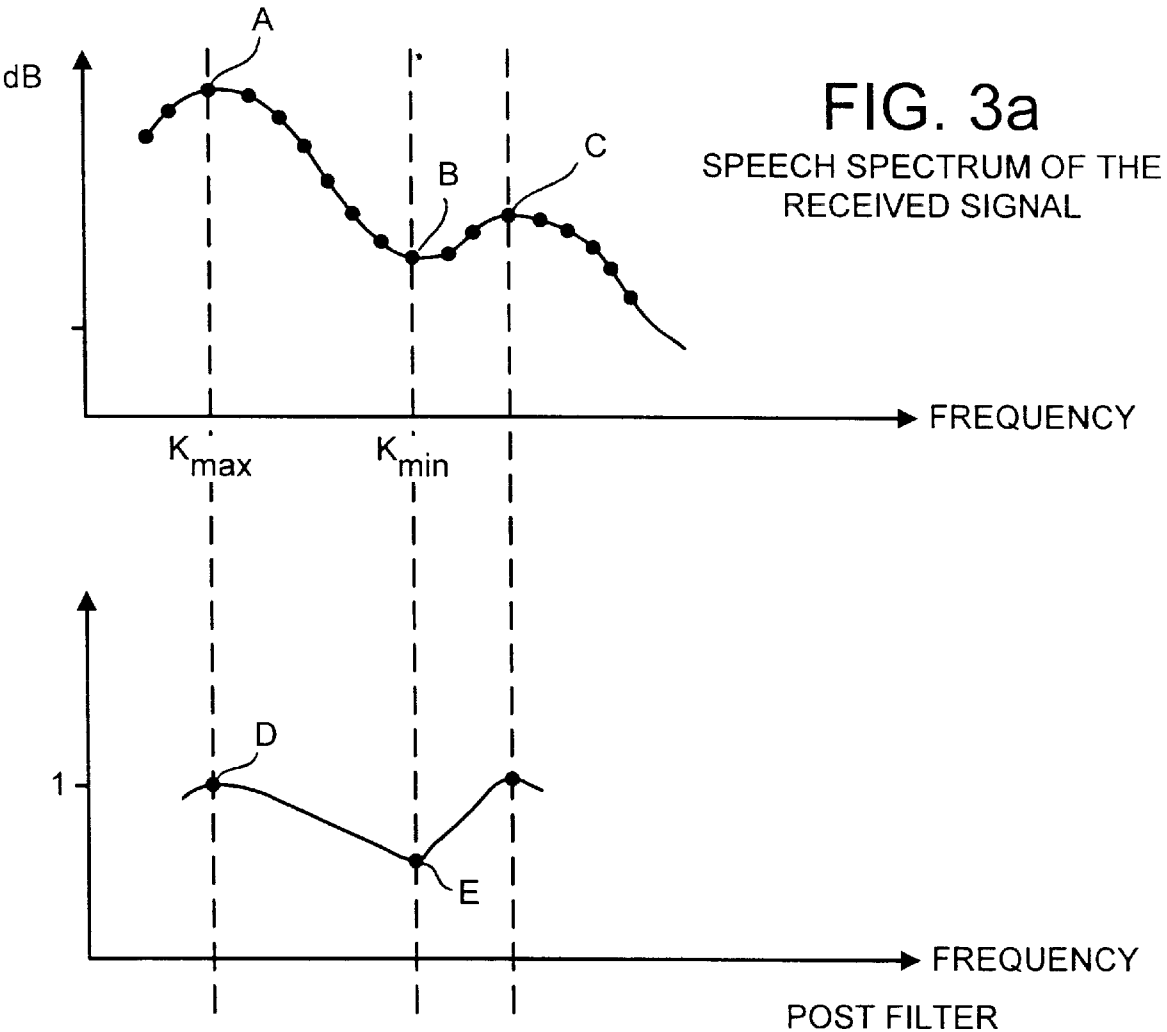
FIG. 3a SPEECH SPECTRUM OF THE RECEIVED SIGNAL
FIG. 3b POST FILTER FREQUENCY RESPONSE

CALCULATING A POSTFILTER FREQUENCY RESPONSE FOR FILTERING DIGITALLY PROCESSED SPEECH

FIELD OF THE INVENTION

This invention relates to a method and apparatus for postfiltering a digitally processed signal.

DESCRIPTION OF THE PRIOR ART

To enable transmission of speech at low bit rates various types of speech encoders have been developed which are used to compress a speech signal before the signal is transmitted. On receipt of the compressed signal the receiver decompresses the signal before finally being reconverted back into an audio signal.

Even though, over the same bandwidth, a compressed speech signal allows more information to be transmitted than an uncompressed signal, the quality of digitally compressed speech signals is often degraded by, for example, background noise, coding noise and by noise due to transmission over a channel.

In particular, as the encoding rate of the processed signal is reduced, the SNR also drops and the noise floor of the coding noise rises. At low encoding rates it can become impossible to keep the noise below the audible masking threshold and hence the noise can contribute to the overall roughness of the speech signal.

Two techniques have been developed to deal with this problem. The first technique uses noise spectral shaping at the speech encoder. The idea behind spectral shaping is to shape the spectrum of the coding noise so that it follows the speech spectrum, otherwise known as the speech spectral envelope. Spectrally shaped noise, when coded, is less audible to the human ear due to the noise masking effect of the human auditory system. However, at low encoding rates noise spectral shaping alone is not sufficient to make the coding noise inaudible. For example, even with noise spectral shaping, the quality of a Code Excited Linear Prediction (CELP) coder having an encoding rate of 4.8 kb/s is still perceived as rough or noisey. The second technique uses an adaptive postfilter at the speech decoder output and typically comprises a short term postfilter element and a long term postfilter element. The purpose of the long term postfilter is to attenuate frequency components between pitch harmonic peaks. Whereas the purpose of the short term postfilter is to accurately track the time-varying nature of the speech signal and suppress the noise residing in the spectral valleys. The frequency response of the short term postfilter typically corresponds to a modified version of the speech spectrum where the postfilter has local minimums in the regions corresponding to the spectral valleys and local maximums at the spectral peaks, otherwise known as formant frequencies. The dips in the regions corresponding to the spectral valleys (i.e. local minimums) will suppress the noise, thereby accomplishing noise reduction. This has the effect of removing noise from the perceived speech signal. The local maximums allow for more noise in the formant regions, which is masked by the speech signal. However, some speech distortion is introduced because the relative signal levels in the formant regions are altered due to the postfiltering.

Most speech codecs use a time domain based postfilter based on U.S. Pat. No. 4,969,192. In this technique the postfiltering is implemented temporally as a difference equation. As such, the postfilter can be described by a transfer function. Consequently it is not possible to independently control the different portions of the frequency spectrum with the result that noise reduction by suppressing the noise around the spectral valleys distorts the speech signal by sharpening the formant peaks.

Consequently, most current short term postfilters shape the spectrum such that the formants become narrower and more peaky. Whilst this reduces the noise in the valleys, it has the side effect of altering the spectral shape such that the speech becomes boomy and less natural. This effect is especially prevalent when large amounts of post filtering is applied to the signal, as is the case for Pitch Synchronous Innovation-CELP (PSI-CELP).

SUMMARY OF THE INVENTION

In accordance with one aspect of the present invention there is provided a method for calculating a short term postfilter frequency response for filtering digitally processed speech, the method comprising identifying at least one formant of the speech spectrum; and normalizing points of the speech spectrum with respect to the magnitude of an identified formant.

Using this method it is possible to independently control different portions of the frequency spectrum.

Preferably the points of the speech spectrum are normalised with respect to the magnitude of the nearest formant.

Most preferably the points of the speech spectrum are normalised according to a function of the form $$R_{post}(k) = \left(\frac{R(k)}{R_{form}(k)}\right)^{\beta}$$

Where R(k) is the amplitude of the spectrum at a frequency k and $R_{form}(k)$ is the amplitude of the spectrum at a frequency k which corresponds to an identified formant frequency and β controls the degree of postfiltering. Where $$\beta = \frac{k_{\min} - k}{k_{\min} - k_{\max}} \cdot \gamma \text{ for } k_{\max} < k \le k_{\min} \text{ and } \beta = \frac{k_{\min} - k}{k_{\min} - k_{\max}} \cdot \gamma \text{ for } k_{\min} < k \le k_{\max}$$

where k is a point in frequency, $k_{min}$ is the frequency of a spectral valley, $k_{max}$ is the frequency of a formant and γ controls the degree of postfiltering i.e controls the depth of the postfilter valleys.

Preferably the at least one formant is identified by finding a first derivative of the speech spectrum.

In accordance with a second aspect of the present invention there is provided a postfiltering method for enhancing a digitally processed speech signal, the method comprising obtaining a speech spectrum of the digitally processed signal; identifying at least one formant of the speech spectrum; normalising points of the speech spectrum with respect to the magnitude of an identified formant to produce a postfilter frequency response; and filtering the speech spectrum of the digitally processed signal with the postfilter frequency response.

In accordance with a third aspect of the present invention there is provided a postfilter comprising identifying means for identifying at least one formant of a digitally processed speech spectrum; normalising means for normalising points of the speech spectrum with respect to the magnitude of an identified formant to produce a postfilter frequency response; means for filtering the digitally processed speech spectrum with the postfilter frequency response.

In accordance with a fourth aspect of the present invention there is provided a radiotelephone comprising a postfilter, the postfilter having identifying means for identifying at least one formant of a digitally processed speech spectrum; normalising means for normalising points of the speech spectrum with the magnitude of an identified formant to produce a postfilter frequency response; means for filtering the digitally processed speech spectrum with the postfilter frequency response.

BRIEF DESCRIPTION OF THE DRAWINGS

The invention will now be described, by way of example only, with reference to the accompanying drawings, in which:

FIGS. 3*a* and 3*b* illustrate an example of a frequency response of a postfilter according to the present invention compared with the corresponding postfiltered speech spectrum;

DETAILED DESCRIPTION OF THE INVENTION

The embodiment of the invention described below is based on the postfiltering of a digitally processed signal by means of a time domain adaptive predictive coder, for example Residual Excited Linear Prediction (RELP) and CELP coders/decoders. However, this invention is equally applicable to the postfiltering of a digitally processed speech signal by means of a frequency domain coder/decoder, for example SBC and MBE coders/decoders.

Figure 1:
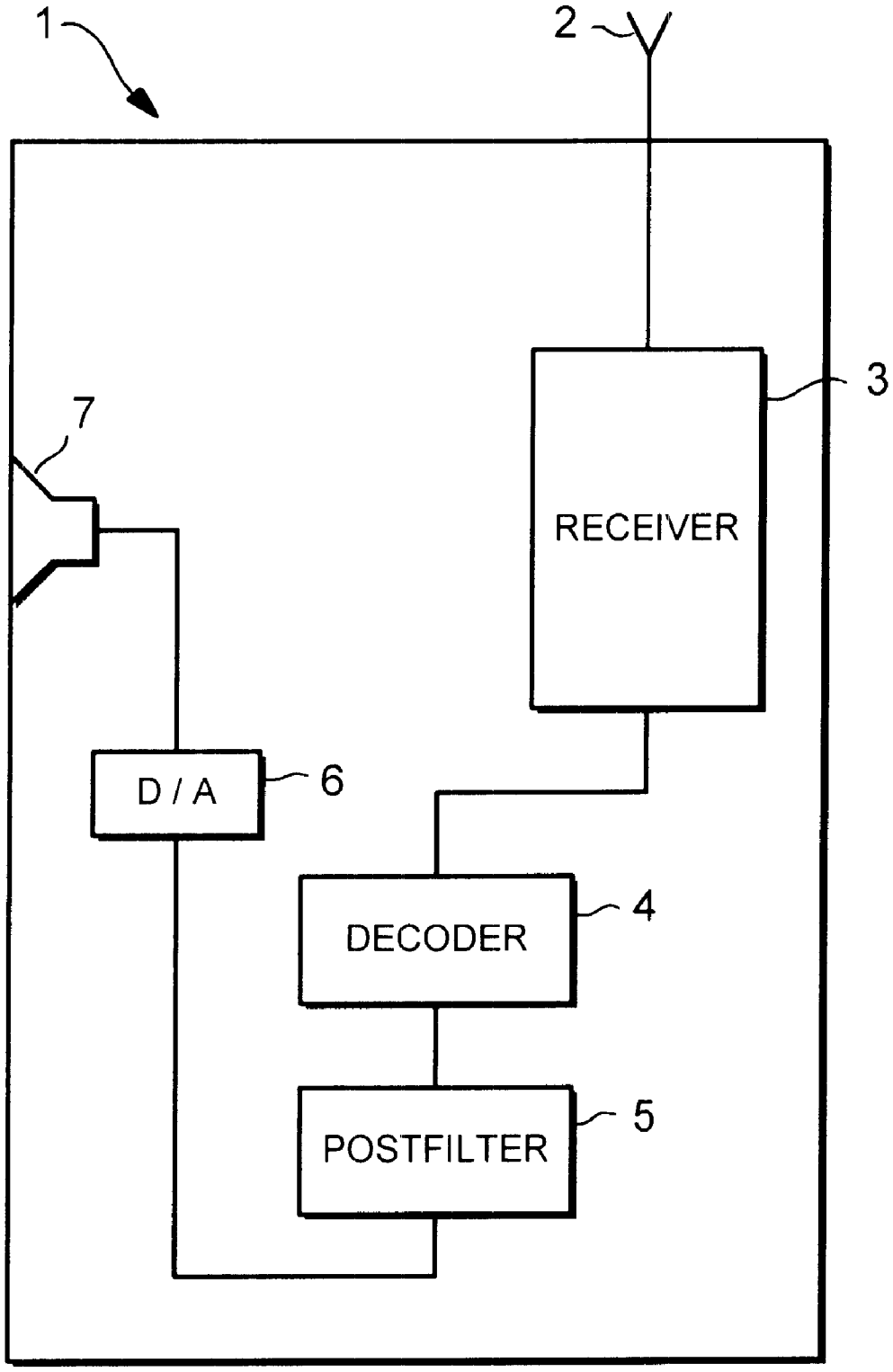
FIG. 1 is a schematic block diagram of a radio telephone incorporating a postfilter according to the present invention.

FIG. 1 shows a digital radiotelephone 1 having an antenna 2 for transmitting signals to and for receiving signals from a base station (not shown). During reception of a call the antenna 2 supplies an encoded digital radio signal, which represents an audio signal transmitted from a calling party, to the receiver 3 which converts the low power radio frequency into a low frequency signal which is then demodulated. The demodulated signal is then supplied to a decoder 4, which decodes the signal before passing the signal to the postfilter 5. The postfilter 5 modifies the signal, as described in detail below, before passing the modified signal to a digital to analogue converter 6. The analogue signal is then passed to a speaker 7 for conversion into an audio signal.

Figure 2:
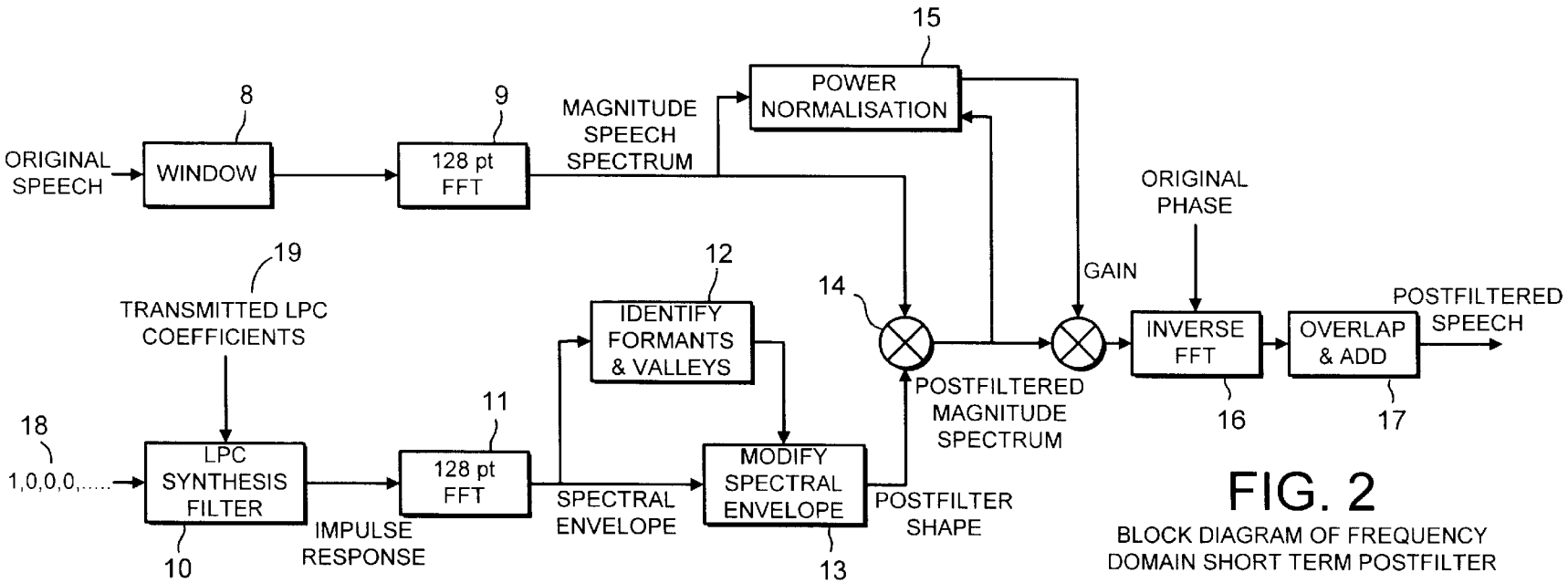
FIG. 2 is a schematic block diagram of a postfilter according to the present invention.

As stated above, after the signal has been decoded the signal is then passed to postfilter 5. Referring to FIG. 2 on receipt of the signal by the postfilter, the signal is passed to a windowing function 8 which divides the signal into frames. The frame size determines how often the frequency response of the postfilter is updated. That is to say, a larger frame size will result in a longer time between the recalculation of the postfilter frequency response than a shorter frame size. In this embodiment a frame size of 80 samples is used which is windowed using a trapezoidal window function (i.e. a quadrilateral having only one pair of parallel sides). The 80 samples correspond to 10 ms when using a 8 kHz sampling rate. The process uses an overlap of 18 samples to remove the effect of the shape of the window function from the time domain signal. Once the encoded speech has been windowed the frame is padded with zeroes to give 128 data points. The speech signal frames are then supplied to a Fast Fourier Transform function 9, which converts the time domain signal into the frequency domain using a 128 point Fast Fourier Transform.

The postfilter 5 has a Linear Prediction Coefficient filter 10, which typically has the same characteristics as the synthesis filter in the decoder 4. An approximation of the speech signal is obtained by finding the impulse response of the LPC synthesis filter 10 using the transmitted LPC coefficients 19 and the pulse train 18. The impulse response of LPC filter 10 is then supplied to a Fast Fourier Transform function 11, which converts the impulse response into the frequency domain using a 128 point Fast Fourier Transform in the same manner as described above. The frequency transform of the impulse response provides an approximation of the spectral envelope of the speech signal.

The above description describes how a time domain signal is converted into the frequency domain. This is relevant for time domain coders such as CELP and RELP. Frequency domain coders, however, need no such conversion.

The approximation of the spectral envelope of the speech signal is passed to a spectral envelope modifying function 13 and a formants identifying function 12. The formants identifying function 12 uses the FFT output to identify the turning points of the spectral envelope by finding the first derivative on a spectral bin by spectral bin basis i.e. for each output point of the FFT function 11. This provides the positions of the maximum and minimums of the spectral envelope which correspond to the formants and spectral valleys respectively.

The formant identifying function 12 passes the positions of the formants that have been identified to the spectral envelope modifying function 13. The modifying function 13 calculates the postfilter frequency response by normalising each point of the spectral envelope with respect to the magnitude of its nearest formant. If more than one formant has been identified each point of the spectral envelope can be normalised with reference to one of the formants, however preferably the normalisation of each point should be with respect to its nearest formant.

A preferred normalisation equation is shown in equation 1.

$$R_{post}(k) = \left(\frac{R(k)}{R_{form}(k)}\right)^{\beta} \text{ where } 0 \le k < 64 \qquad \text{Equation 1}$$

As FFT output is symmetrical the upper value of k is typically chosen to be half the Fast Fourier Transform. Therefore, in this embodiment the upper limit of k is 64.

R(k) is a point on the spectral envelope, $R_{form}(k)$ is the magnitude of the nearest formant, and k is a point in frequency.

for $k_{max} < k \leqq k_{min}$ β is given by equation 2

$$\beta = \frac{k_{\min} - k}{k_{\min} - k_{\max}} \cdot \gamma \qquad \text{Equation 2}$$

for $k_{min} < k \leqq k_{max}$ β is given by equation 3

$$\beta = \frac{k_{\max} - k}{k_{\max} - k_{\min}} \cdot \gamma \qquad \text{Equation 3}$$

where k is a point in frequency, $k_{min}$ is the frequency of a spectral valley, $k_{max}$ is the frequency of a formant.

γ controls the degree of postfiltering (i.e. controls the depth of the postfilter valleys) and is preferably chosen to lie between 0.7 and 1.0. Equations 2 and 3 ensure that there is a gradual de-emphasis of the spectral valleys such that maximum attenuation occurs at the bottom of the valley.

FIG. 3*b* shows a representation of the postfilter frequency response according to equation 1 while FIG. 3*a* shows the corresponding spectral envelope of the received signal. As point A is a maximum (i.e. a formant) this is normalised to one at point D on the postfilter frequency response. The sample positions between point A and B are correspondingly normalised with reference to point A. The sample positions between point B and C are normalised with reference to point C. Point B can be normalised with reference to either point A or C.

To increase the brightness of the speech the modified spectrum can be passed to a high pass filter (not shown) which adds a slight high frequency tilt to the speech. In the frequency domain this is given by Equation 4.

$$1-\mu\cos\frac{2\pi k}{64}+\mu^2 \qquad \text{Equation 4}$$

Once the postfilter frequency response has been calculated it is passed to a multiplier 14 which multiplies the modified spectrum with the original noisy speech spectrum to give the postfiltered speech magnitude spectrum, as shown in equation 5.

$$|S_{post}(k)| = |S(k)|\cdot R_{post}(k)\cdot\left(1-\mu\cos\frac{2\pi k}{64}+\mu^2\right) \qquad \text{Equation 5}$$

Additionally, power normalisation can also be carried out in the frequency domain, to scale the postfiltered speech such that it has roughly the same power as the unfiltered noisy speech. One technique used to normalise the output signal power is for a power normalisation function 15 to estimate the power of the unfiltered and filtered speech separately using inputs from the noisy speech spectrum and the postfiltered spectrum, then determine an appropriate scaling factor based on the ratio of the two estimated power values. One example of a possible gain factor g is given by $$g=\sqrt{\frac{\sum_{k=0}^{N-1}|S_{post}(k)|^2}{\sum_{k=0}^{N-1}|S(k)|^2}}$$

Therefore, the normalised postfilter speech spectrum $S_{np}$ is given by $$|S_{np}(k)| = g\cdot|S_{post}(k)|$$

The postfilter spectrum is passed to an inverse Fast Fourier Transform function 16, which performs an inverse FFT on the spectrum in order to bring the signal back into the time domain. The phase components for the inverse FFT are those of the original speech spectrum. Finally the overlap and add function 17 is used to remove the effect of the window function.

The present invention may include any novel feature or combination of features disclosed herein either explicitly or implicitly or any generalisation thereof irrespective of whether or not it relates to the presently claimed invention or mitigates any or all of the problems addressed. In view of the foregoing description it will be evident to a person skilled in the art that various modifications may be made within the scope of the invention. For example, it will be appreciated that the postfilter may also include a long term postfilter in series with the short term postfilter.

What is claimed is:

1. A method for calculating a postfilter frequency response for filtering digitally processed speech, the method comprising identifying at least one formant of a speech spectrum of the digitally processed speech; and normalising points of the speech spectrum with respect to the magnitude of an identified formant, wherein the points of the speech spectrum are normalised according to a function of the form $$R_{post}(k)=\left(\frac{R(k)}{R_{form}(k)}\right)^{\beta}$$

where R(k) is the amplitude of the spectrum at a frequency k and $R_{form}(k)$ is the amplitude of the spectrum at a frequency k which corresponds to an identified formant frequency and β controls the degree of postfiltering, and $$\beta=\frac{k-k_{\max}}{k_{\min}-k_{\max}}o\gamma \quad \beta=\frac{k_{\min}-k}{k_{\min}-k_{\max}}o\gamma \text{ for } k_{\max}<k\le k_{\min} \text{ and } \beta=\frac{k_{\max}-k}{k_{\max}-k_{\min}}o\gamma \text{ for } k_{\min}<k\le k_{\max}$$

where k is a point in frequency, $k_{min}$ is the frequency of a spectral valley, $k_{max}$ is the frequency of a formant and γ controls the degree of postfiltering.

2. A method according to claim 1, wherein the at least one format is identified by finding a first derivative of the speech spectrum.

3. A postfiltering method for enhancing a digitally processed speech signal, the method comprising obtaining a speech spectrum of the digitally processed signal;

identifying at least one formant of the speech spectrum;

normalising points of the speech spectrum with the magnitude of an identified formant to produce a postfilter frequency responses filtering the speech spectrum of the digitally processed signal with the postfilter frequency response, wherein the points of the speech spectrum are normalised according to a function of the form $$R_{post}(k)=\left(\frac{R(k)}{R_{form}(k)}\right)^{\beta}$$

where R(k) is the amplitude of the spectrum at a frequency k and $R_{form}(k)$ is the amplitude of the spectrum at a frequency k which corresponds to an identified formant frequency and β controls the degree of postfiltering, and $$\beta=\frac{k-k_{\max}}{k_{\min}-k_{\max}}o\gamma \quad \beta=\frac{k_{\min}-k}{k_{\min}-k_{\max}}o\gamma \text{ for } k_{\max}<k\le k_{\min} \text{ and } \beta=\frac{k_{\max}-k}{k_{\max}-k_{\min}}o\gamma \text{ for } k_{\min}<k\le k_{\max}$$

where k is a point in frequency, $k_{min}$ is the frequency of a spectral valley, $k_{max}$ is the frequency of a formant and γ controls the degree of postfiltering.

4. A method according to claim 3, wherein at least one formant is identified by finding a first derivative of the speech spectrum.

5. A postfilter comprising identifying means for identifying at least one formant of a digitally processed speech spectrum; normalising means for normalising points of the speech spectrum with respect to the magnitude of an identified formant to produce a postfilter frequency response; and means for filtering the digitally processed speech spectrum with the postfilter frequency response, wherein the normalising means normalises points of the speech spectrum according to a function of the form $$R_{post}(k) = \left(\frac{R(k)}{R_{form}(k)}\right)^{\beta}$$

where R(k) is the amplitude of the spectrum at a frequency k and $R_{form}(k)$ is the amplitude of the spectrum at a frequency k which corresponds to an identified formant frequency and β controls the degree of postfiltering, and $$\beta = \frac{k - k_{\max}}{k_{\min} - k_{\max}} o\gamma \quad \beta = \frac{k_{\min} - k}{k_{\min} - k_{\max}} o\gamma \quad \text{for}$$

$$k_{\max} < k \le k_{\min} \text{ and } \beta = \frac{k_{\max} - k}{k_{\max} - k_{\min}} o\gamma \text{ for}$$

$$k_{\min} < k \le k_{\max}$$

where k is a point in frequency, $k_{min}$ is the frequency of a spectral valley, $k_{max}$ is the frequency of a formant and γ controls the degree of postfiltering.

6. A postfilter according to claim 5, wherein the identifying means identifies at least one formant by finding a first derivative of the speech spectrum.

7. A radiotelephone comprising a postfilter, the postfilter having identifying means for identifying at least one formant of a digitally processed speech spectrum; normalising means for normalising points of the speech spectrum with respect to the magnitude of an identified formant to produce a postfilter frequency response; and means for filtering the digitally processed speech spectrum with the postfilter frequency response, wherein the normalising means normalises points of the speech spectrum according to a function of the form $$R_{post}(k) = \left(\frac{R(k)}{R_{form}(k)}\right)^{\beta}$$

where R(k) is the amplitude of the spectrum at a frequency k and $R_{form}(k)$ is the amplitude of the spectrum at a frequency k which corresponds to an identified formant frequency and β controls the degree of postfiltering, and $$\beta = \frac{k_{\min} - k}{k_{\min} - k_{\max}} \cdot \gamma \text{ for } k_{\max} < k \le k_{\min} \text{ and } \beta = \frac{k_{\min} - k}{k_{\min} - k_{\max}} \cdot \gamma \text{ for } k_{\min} < k \le k_{\max}$$

where k is a point in frequency, $k_{min}$ is the frequency of a spectral valley, $k_{max}$ is the frequency of a formant and γ controls the degree of postfiltering.

* * * * *